US005931689A

United States Patent [19]

Patel

[11] Patent Number: 5,931,689

[45] Date of Patent: Aug. 3, 1999

[54] ELECTRIC CONNECTOR ASSEMBLY WITH IMPROVED LOCKING CHARACTERISTICS

[75] Inventor: Arvind Patel, Naperville, Ill.

[73] Assignee: Molex Incorporated, Lisle, Ill.

[21] Appl. No.: 08/906,694

[22] Filed: Aug. 6, 1997

[51] Int. Cl.[6] ..... H01R 4/50

[52] U.S. Cl. ..... 439/346; 439/74

[58] Field of Search ..... 439/74, 78, 83, 439/346, 350, 357, 660

[56] References Cited

U.S. PATENT DOCUMENTS

| | | | |
|---|---|---|---|
| 4,113,179 | 9/1978 | McKee . | |
| 4,993,956 | 2/1991 | Pickles et al. | 439/74 |
| 5,057,028 | 10/1991 | Lemke et al. . | |
| 5,199,884 | 4/1993 | Kaufman et al. . | |
| 5,199,885 | 4/1993 | Korsunsky et al. . | |
| 5,224,866 | 7/1993 | Nakamura et al. | 439/346 X |
| 5,320,541 | 6/1994 | Korsunsky et al. . | |
| 5,395,250 | 3/1995 | Englert, Jr. et al. . | |
| 5,403,215 | 4/1995 | Buchter et al. . | |
| 5,476,389 | 12/1995 | Ono | 439/83 |
| 5,498,167 | 3/1996 | Seto et al. | 439/74 |
| 5,639,248 | 6/1997 | Yagi | 439/74 |
| 5,727,956 | 3/1998 | Mitra et al. | 439/74 |

FOREIGN PATENT DOCUMENTS

| | | |
|---|---|---|
| 0658951 A1 | 7/1994 | European Pat. Off. . |
| 0717463 A2 | 6/1996 | European Pat. Off. . |
| 62-500974 | 4/1987 | Japan . |
| 7-16381 | 3/1995 | Japan . |
| 8-162210 | 6/1996 | Japan . |

*Primary Examiner*—Khiem Nguyen
*Attorney, Agent, or Firm*—James C. Paschall

[57] ABSTRACT

A connector assembly for holding connector components together. A plug connector in the assembly has a housing with side walls and a pedestal for housing contact portions of terminals which engage contact portions of terminals in an opposing receptacle connector. End walls of the pedestal include a laterally, central projection for engagement with corresponding indentations in end walls of an opposing receptacle connector. The projection is disposed in the plug connector at a different elevation than the tops of the contact portions so engagement with corresponding components of the receptacle connector are not simultaneous to dilute insertion force.

17 Claims, 6 Drawing Sheets

ELECTRIC CONNECTOR ASSEMBLY WITH IMPROVED LOCKING CHARACTERISTICS

BACKGROUND OF THE INVENTION

The present invention relates generally to electrical connectors of reduced size, and more particularly to surface mount miniature connector assemblies with improved means for registering and holding the components of the connector assembly together.

The trend of the electronics industry is to constantly reduce the size of electronic devices. Many electronic devices rely upon circuitry formed upon various printed circuit boards. These printed circuit boards must be joined together with connectors in a manner to effectively and reliably interconnect the circuits on one circuit board to the circuits on another circuit board.

In order to permit the connection of two circuit boards in parallel planes and to reduce the size of electronic devices, the connector industry developed the surface mount connector. A typical surface mount connector utilizes a plug-type male connector component that unites with an opposing receptacle-type, or female connector component. Both connector components are of low profile, allowing the circuit boards to be closely spaced to each other. When the connector components are engaged together, the mating terminals of the connector components form an electrical connection between the circuits of the two circuit boards.

It is desirable to retain the connector components in engagement with each other, and to fulfill this need, locking mechanisms have been developed for such connectors. The use of locking mechanisms that are separate from the connector components may lead to more complex structure and larger sizes of connectors. When the locking mechanisms are formed as part of the connector component housings, they waste space on the connector, and because the mechanisms are made entirely from plastic, the locking mechanism will not be sufficiently strong.

In some connection applications the size of the connectors are extremely small, in what is known as the "micro-miniature" range. Securely holding such small connectors together is difficult. The approach in the industry with small connectors is to utilize frictional force to hold the connectors together. However, such frictional forces will not always reliably resist accidental unmating. Additionally, insertion forces cannot be so excessive as to cause difficultly in mating such connectors. Moreover, properly registering small connectors to effect mating can be very difficult. Accordingly, the need exists for an easily registerable board to board connector that has a high degree of mechanical integrity and requires a sufficiently strong withdrawal force and a sufficiently light insertion force.

The present invention is therefore directed to an electric connector assembly which overcomes the aforementioned disadvantages and facilitates registering and holding the associated connector components together regardless of connector size.

SUMMARY OF THE INVENTION

To attain this and other objects, an electric connector assembly constructed in accordance with the principles of the present invention and as exemplified by a preferred embodiment thereof comprises a pair of connector components, each of the components having an insulative housing and a plurality of terminals fixed to the housing and arranged at regular intervals therein. The connector assembly has a first locking, or retention mechanism, in that the terminals of one of the connector components have locking portions formed thereon that are adapted to engage one or more catches formed on the other connector housing. The terminals of one connector component engage the catches of the other connector component when the two connector components are mated together with their terminals engaged with each other, thereby fastening and retaining the connector components together.

The first connector component, a plug connector, has terminals that are stamped and formed from conductive metal blanks to define on each terminal, a body portion and a contact portion, a locking portion and a solder tail portion all extending from the body portion. The contact and locking portions of the terminal are spaced apart from each other to define a space or nest therebetween that receives a portion of the housing of the other connector component therein. In this arrangement, the locking and contact portions oppose each other. The locking portions may preferably be formed coincidentally with the engagement portions in a vertical fashion on the same post which further reduces the horizontal or width dimensions of the connector assembly. The engageable locking portions and the catches are generally arranged in alignment with a widthwise axis of the connector assembly.

The plug connector comprises pairs of opposed side walls which surround a pedestal all projecting upwardly from a floor of the housing. The outer edges of the pedestal and the inner edges of the side walls and the end walls define a channel in communication with contact portions and the locking portions of the terminals. The top surface of the pedestal protects the contact portions from accidental contact.

The second connector component, a receptacle connector, comprises a housing of side walls and end walls partitioned by a floor into a mating recess and a mounting recess. The mating recess receives the pedestal of the plug connector during mating. Upon mating, terminals in the side walls of the receptacle connector engage contact portions of terminals in the plug connector, thereby effecting electrical contact between the terminals of the connector assembly. Locking portions of the terminals of the plug connector engage catches in the receptacle connector to maintain mating.

In a first embodiment of the invention, the pedestal has a taller height above the floor of the housing than the pairs of opposed side walls. The opposed side walls of the receptacle connector are the same height. During mating, the taller pedestal of the plug connector is easily registered between the opposed side walls of the receptacle connector. Upon registration, the plug connector and the receptacle connector are permitted to move closer together, which is physically detectable. Continuing the movement of the plug and receptacle connectors closer together will terminate with the connectors fully engaged, the corresponding contact portions of the terminals of each connector in electrical contact with each other and locking portions of the terminals in the plug connector in engagement with catches in the receptacle connector. The taller pedestal of the plug connector facilitates registration and mating of miniature connectors for which registration and mating would be otherwise difficult.

In a second embodiment of the invention, an additional locking mechanism may be provided by configuring complementary shaped projections and recesses in opposing surfaces of the two interengageable connector housings that are disposed generally transversely to the array of terminals of the connector component terminals. This second locking mechanism extends in alignment with a longitudinal axis of the connector assembly to provide the connector with stability along its longitudinal axis. This locking means formed in the connector housings assists in aligning the terminals of the two connector components together along this longitudinal axis.

In a third embodiment of the invention, the plug connector provides a three-stage insertion action with the receptacle connector. Projections are located on end walls of the pedestal at a height from the floor of the housing which is greater than the height of the contact portions of the terminals from the floor. Additionally, the contact portions of the terminals in the plug connector are taller than the engagement portions of the terminals with respect to the floor of the housing. Accordingly, during mating, the projections of the plug connector firstly engage the receptacle connector and encounter resistance to insertion. The contact portions of the plug connector secondly engage terminals of the receptacle connector and encounter further resistance to insertion. The locking portions of the plug connector thirdly engage the housing of the receptacle connector and encounter additional resistance to insertion. By staggering the sequence of engagement the overall insertion force is diluted. The resistance to withdrawal is not so staggered, and is therefore not similarly diluted.

A fourth embodiment of the invention includes a retention portion on the terminals for retaining the terminals in the plug connector. The retention portion has two symmetrical edges. An insertion segment on each edge tapers toward an upper vertical segment which adjoins a radiused recess which adjoins a lower vertical segment. Areas of the retention portion adjacent the insertion edge and the upper vertical edge are coined to facilitate skiving into terminal retention cavities in the housing.

It will be seen that the present invention provides an easily registerable board-to-board connector which reliably maintains mating engagement of the connector with a mating connector.

BRIEF DESCRIPTION OF THE DRAWINGS

In the course of the following detailed description reference will be frequently made to the accompanying drawings in which.

DESCRIPTION OF THE PREFERRED EMBODIMENTS

Figure 1:
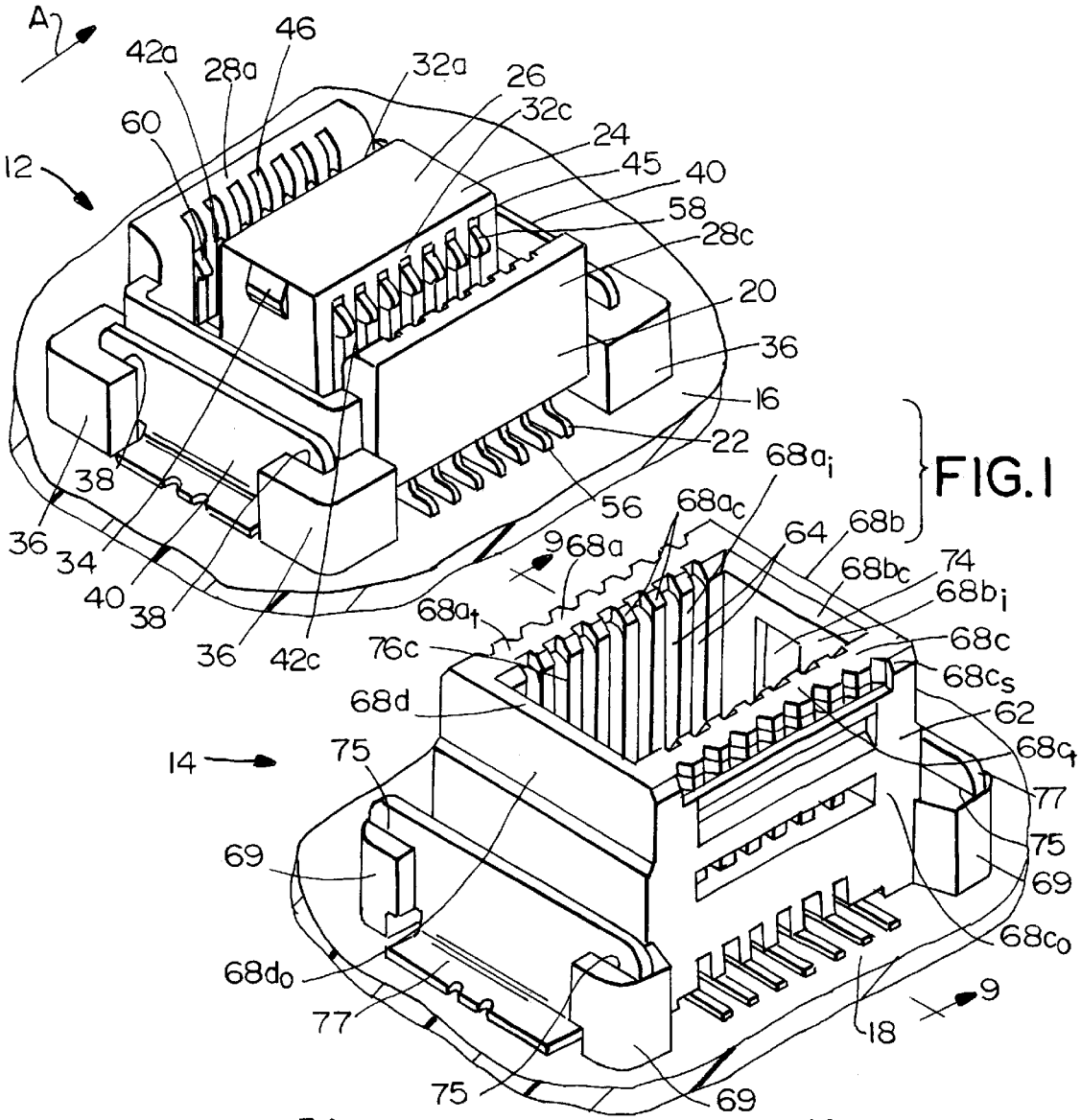
FIG. 1 is a perspective view of an electric connector assembly constructed in accordance with the principles of the present invention.

Referring to the drawings, FIGS. 1–11 illustrate an embodiment of an electric connector assembly 10 constructed in accordance with the principles of the present invention. It can be seen that the connector assembly 10 comprises a pair of connectors 12, 14 for connecting one printed circuit board 16 to another printed circuit board 18. The plug connector 12 is shown as fixed to the printed circuit board 16, while the receptacle connector 14 is shown in FIG. 1 as fixed to the other printed circuit board 18.

Referring now to FIGS. 1–6, the plug connector 12 includes a housing 20 of an insulative material, such as plastic, and a plurality of conductive terminals 22 arranged at regular intervals along the length of the plug connector 12. The terminals 22 are arranged in two distinct sets, or arrays, along longitudinal axis A and are fixed to the insulative housing 20. The plug housing 20 has an upstanding central portion, shown as a pedestal 24. The center pedestal 24 has a substantially flat or planar top surface 26 that permits the plug connector 12 to be assembled onto the circuit board 16 with a vacuum pick and place mechanism. The top surface 26 is preferably sufficiently broad to protect tops of the terminals 22 from impact during mating with the receptacle connector 14 which could adversely deform the terminal 22.

Figure 2:
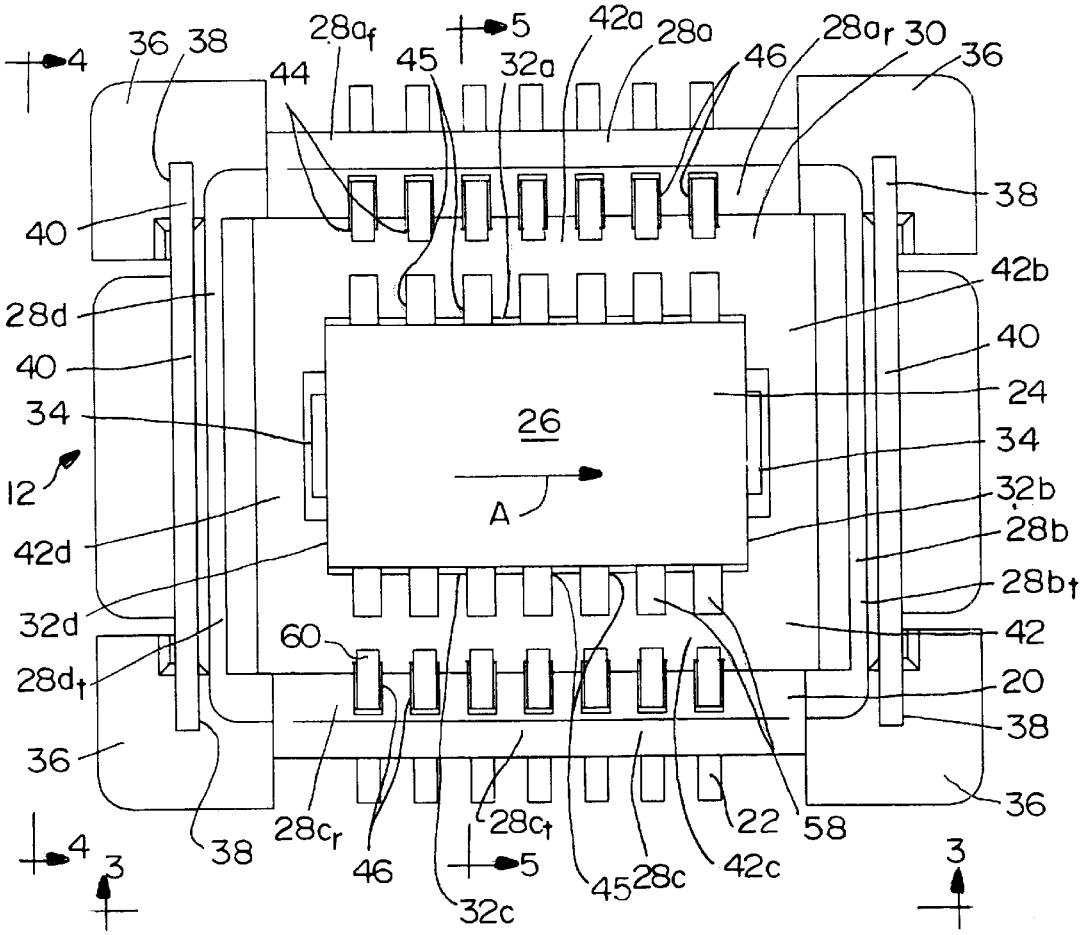
FIG. 2 is a top plan view of the plug connector of FIG. 1.
Figure 3:
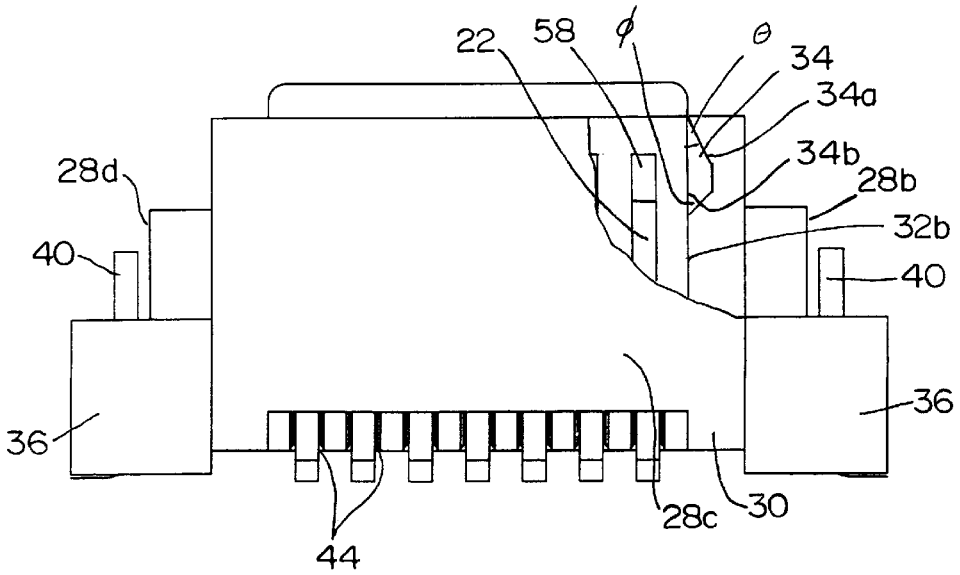
FIG. 3 is a side elevational view of the plug connector taken along line 3—3 in FIG. 2 with a portion broken away.
Figure 4:
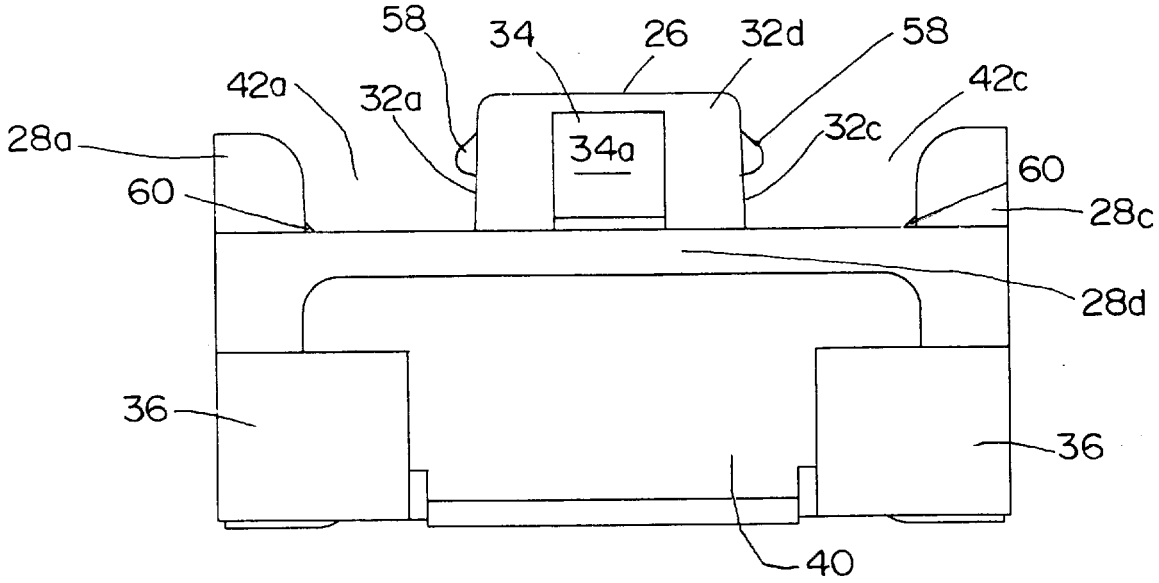
FIG. 4 is an end elevational view of the plug connector taken along lines 4—4 in FIG. 2.
Figure 6:
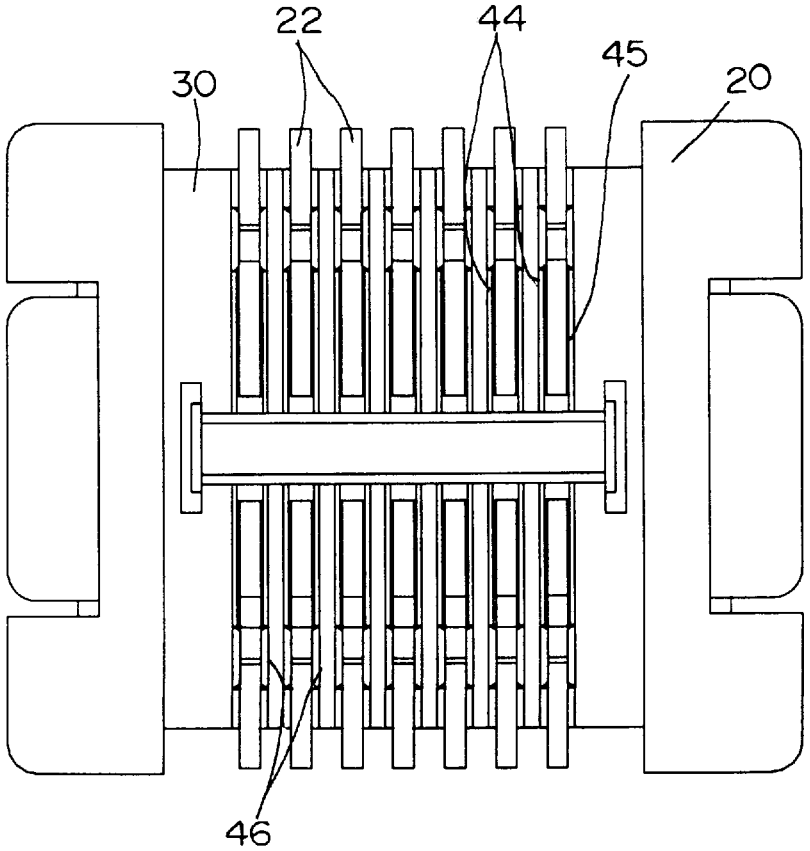
FIG. 6 is a plan bottom view of the plug connector of FIG. 2.
Figure 5:
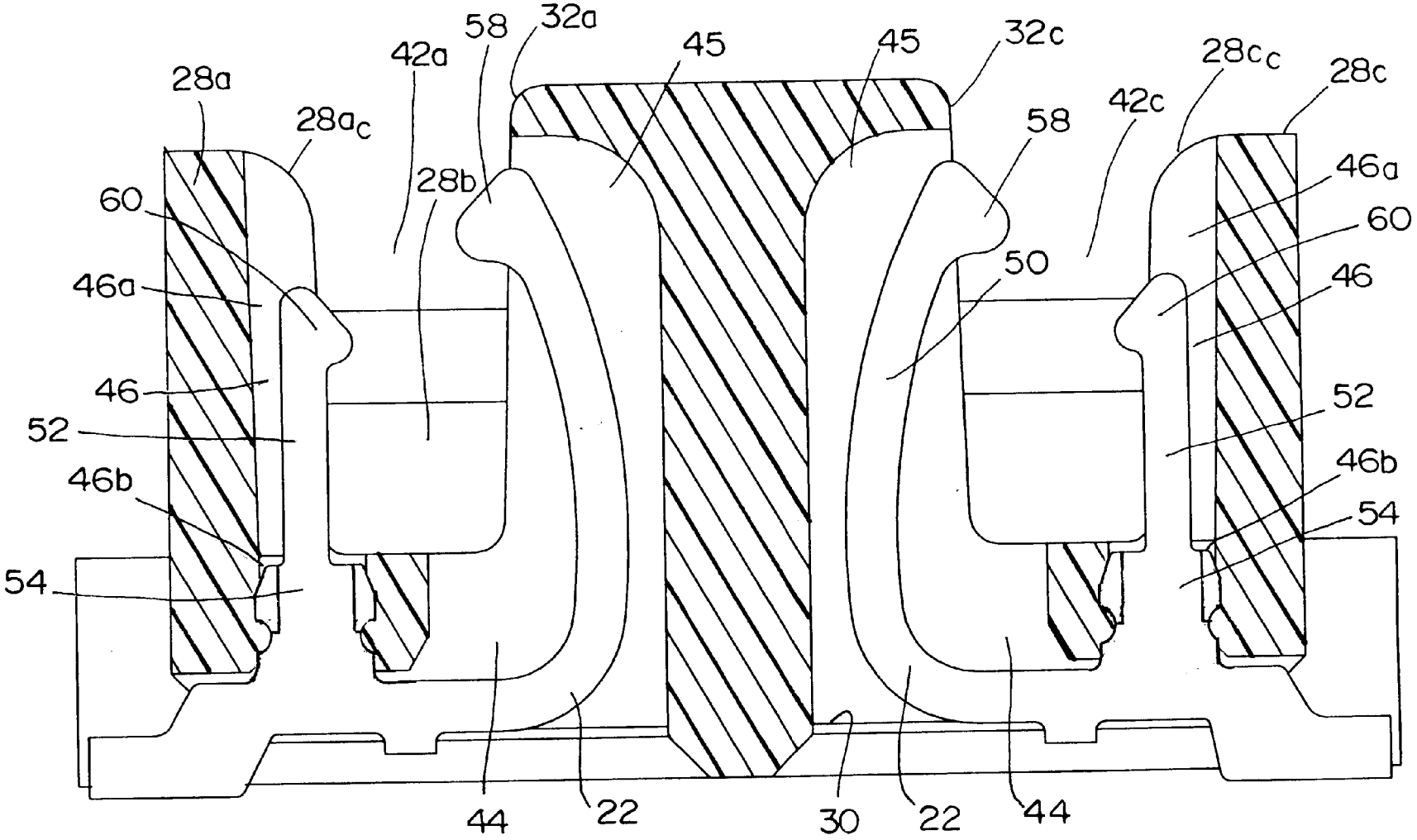
FIG. 5 is a cross-sectional view of the plug connector taken along line 5—5 in FIG. 2.

The pedestal 24 is surrounded by a series of walls 28*a*–28*d* as best shown in FIG. 2. Walls 28*a*, 28*c* are characterized as side walls, and walls 28*b*, 28*d* are characterized as end walls. According to the preferred embodiment of this invention, the top surface 26 of the pedestal 24 is preferably disposed higher above a bottom 30 of the housing 20 than the walls 28a-28*d* as best shown in FIGS. 3, 4 and 5. The side walls 28*a* and 28*c* have radiused inner edges $28a_r$, $28c_r$ to facilitate mating with receptacle connector 14. The side walls 28*a* and 28*c* are the same height as each other and are taller above the bottom 30 than end walls 28*b* and 28*d* which are also the same height.

The pedestal 24 is laterally defined by walls 32*a*–32*d*. End pedestal walls 32*b* and 32*d* include projections 34 near the top surface 26. The projections 34 are disposed in the lateral center of the pedestal end walls 32*b*, 32*d*. The projections include an insertion surface 34*a* and a retention surface 34*b* shown in FIG. 3. The insertion surface 34*a* defines an angle $\phi$ with the respective pedestal wall 32*b*, 32*d* which is smaller than an angle $\phi$ which the retention surface 34*b* defines with the respective pedestal wall 32*b*, 32*d*. The top edge of the insertion surface 34*a* is preferably disposed higher above the bottom 30 than the terminals 22 are tall above the bottom 30 of the housing 20. Moreover, top edges of pedestal walls 32*a* and 32*c* are slightly radiused.

Inner surfaces of walls 28*a*–28*d* and outer surfaces of pedestal walls 32*a*–32*d*, respectively, define a mating channel 42 in which portions of the receptacle connector 14 fit. The mating channel 42 comprises segments 42*a*–42*d*. A plurality of terminal-receiving slots 44 are formed at regular intervals lengthwise along longitudinal segments 42*a* and 42*c* of the mating channel 42 that extend through the bottom 30 of the housing 20. The terminals 22 are inserted into the terminal slots 44 from the bottom 30 of the housing 20. Pedestal walls 32*a* and 32*c* include contact cavities 45 therein. Side walls 28*a* and 28*c* include lock cavities 46 therein.

Figure 8:
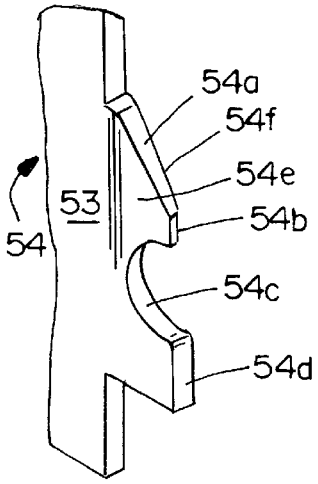
FIG. 8 is a perspective view of the retention portion of the terminal in FIG. 7.
Figure 7:
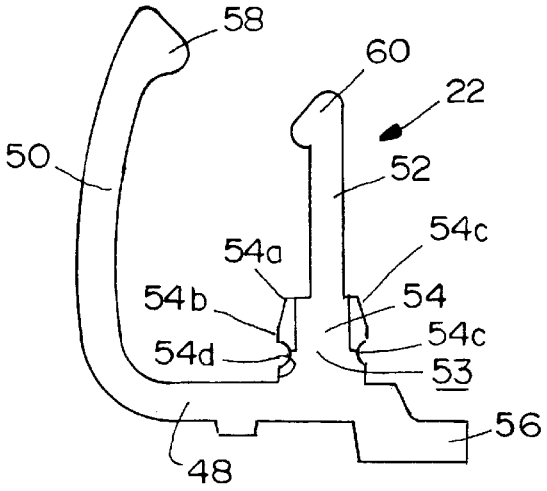
FIG. 7 is an elevational view of the terminal of FIG. 5.

As shown in FIGS. 7 and 8, the terminals 22 used in the plug connector 12 may be formed from metal blanks in a known manner, such as by stamping and forming. Each terminal 22 includes a horizontal base or body portion 48, a contact portion 50 having a free end integrally extending from a front end of the base portion 48, a connector locking portion 52 rising from the base portion 48, a housing retention portion 54 rising from the base portion 48 and a solder tail 56 extending generally horizontally from a rear end of the base portion 48.

The contact portion 50 of the terminal 22 has a contact head 58 projecting from the free end thereof, while the locking portion 52 of the terminal 22 has a locking head 60 projecting from the free end thereof. The contact head 58 and the locking head 60 oppose each other as shown in FIG. 7.

Each terminal 22 may be assembled in the housing 20 by press-fitting the retention portion 54 into the terminal slot 44 of the housing 20. The press-fit enables edges of the retention portion 54 of the terminals 22 to skive into opposing inner walls of the slot 44, to positively retain the terminals 22 in the housing 20. In position, the contact portion 50 and the locking portion 52 are spaced apart from each other across longitudinal segments 42*a* and 42*c*, respectively, of the mating channel 42. The solder tail portions 56 of the terminals 22 extend outwardly of the housing 20 for effective and reliable mounting to a surface of the circuit board 16.

As shown in FIG. 5, the contact portions 50 are disposed in contact cavities 45 in the pedestal walls 32*a*, 32*c*. The locking portions 52 are disposed in locking cavities 46 in the side walls 28*a* and 28*c*. The locking cavity 46 has an upper passage 46*a* which is open to the mating channel segments 42*a*, 42*c*. Preferably, the locking cavity has a lower bore 46*b* which completely, laterally surrounds the locking cavity 46 into which the retention portion 54 skives.

The retention portion 54 is preferably provided on the locking portion 52 above the intersection with the base portion 48. Although the locking portion 52 is offset from the center of the retention portion 54, the retention portion preferably has two symmetrical edges defining a front and back face 53. As shown in FIG. 8, insertion segment 54*a* on each edge tapers toward an upper vertical, straight segment 54*b* which adjoins a radially recessed segment 54*c* which adjoins a lower vertical, straight segment 54*d*. Vertical segments 54*b* and 54*d* are aligned with each other. The corners where the straight, vertical segments 45*b* and 54*d* meet the radially recessed segment 54*c* are slightly radiused. Opposed surfaces 54*e* and 54*f* of the retention portion 54 adjacent the insertion segment 54*a* and the upper vertical segment 54*b* are coined to provide opposing tapered surfaces 54*e*, 54*f* which are transverse to a plane through the faces 53, as shown in FIG. 8. The taper of the insertion segment 54*a* and the coined surfaces 54*e*, 54*f* facilitate skiving into the lower bore 46*b* of the locking cavities 46 in the housing 20 during insertion. Moreover, the radially recessed segments 52*c* facilitate plastic cold flow of the inner surfaces of the bore 46*b* to further facilitate skiving.

End walls 28*b* and 28*d* are each flanked by a pair of opposing supports 36 which descend below the walls 28*a*–28*d* of the housing 20. Each support 36 in each pair includes a slot 38 opposed to a slot 38 in the opposed support 36 in the pair. The pair of opposed slots 38 cooperate to hold a vertical portion of an L-shaped fitting nail 40 for securing the connector 12 to the printed circuit board 10.

Figure 10:
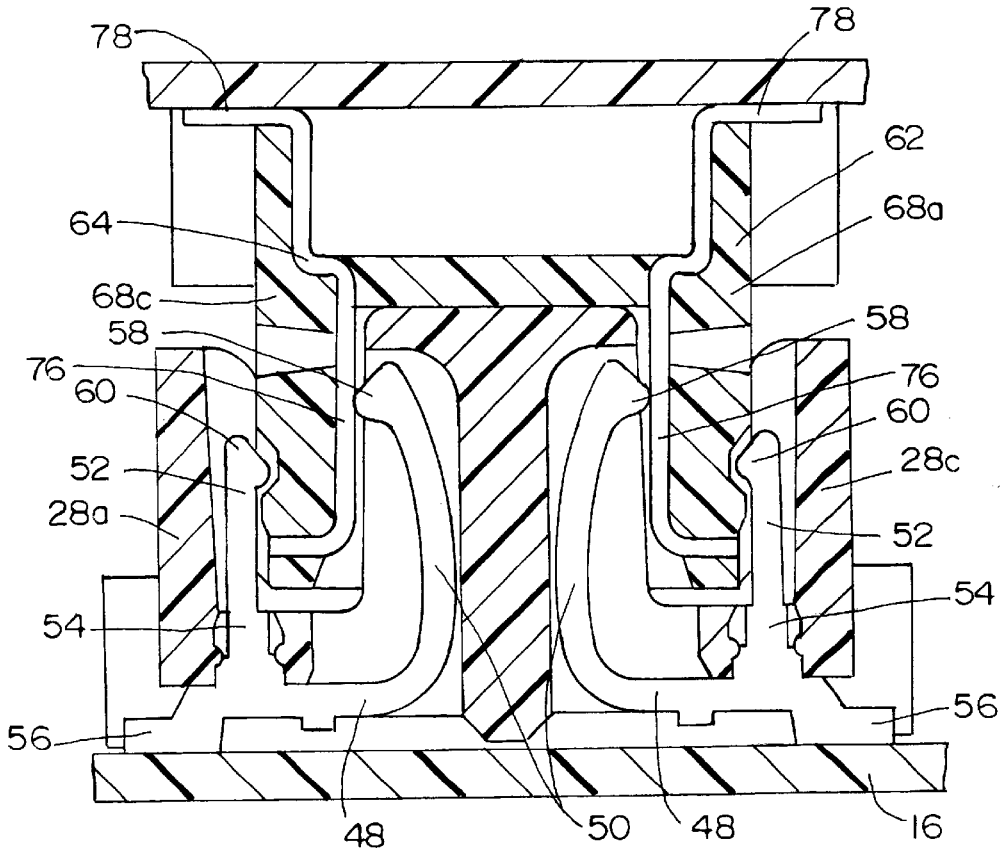
FIG. 10 is a cross sectional view of the plug connector and the receptacle connector of the electric connector assembly of FIG. 9 after mating.
Figure 9:
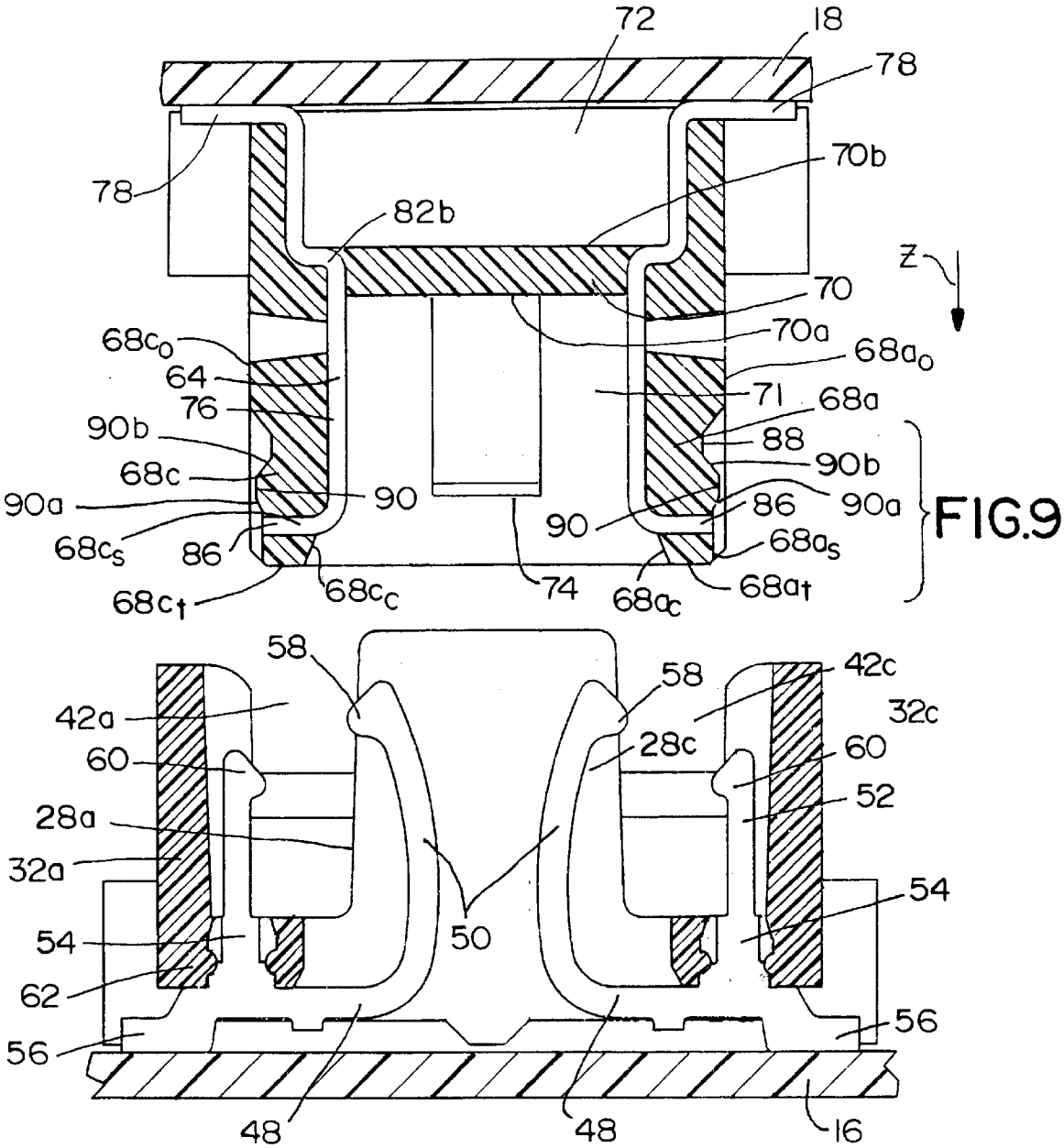
FIG. 9 is a cross-sectional view of plug connector shown in FIG. 5 and the receptacle connector shown in FIG. 1 taken along lines 9—9 of the electrical connector assembly prior to mating.

A description of the receptacle connector 14 is provided to explain how it is mated to the plug connector 12 to complete the assembly 10. Referring now to FIGS. 1, 9 and 10 it can be seen that the receptacle connector 14 includes an insulative housing 62 of plastic and a plurality of conductive terminals 64 longitudinally arranged in the housing 62 at regular intervals in two distinct arrays. The rectangular housing 62 comprises two pairs of opposing side walls 68*a*–68*d* of the same height and a floor 70. The walls 68*a*, 68*c* are characterized as side walls, and the walls 68*b*, 68*d* are characterized as end walls.

The walls 68*a*–68*d* of the housing 62 are provided with inner surfaces $68a_i$–$68d_i$, outer surfaces $68a_o$–$68d_o$ and top surfaces $68a_t$–$68d_i$, respectively and are configured to enter into the mating channel 42 of the plug connector 12 during mating. To facilitate mating, walls 68*a*–68*d* have chamfered top, inner edges $68a_c$–$68d_c$ and side walls 68*a* and 68*c* have slanted top, outer edges $68a_s$, and $68c_s$.

Figure 11:
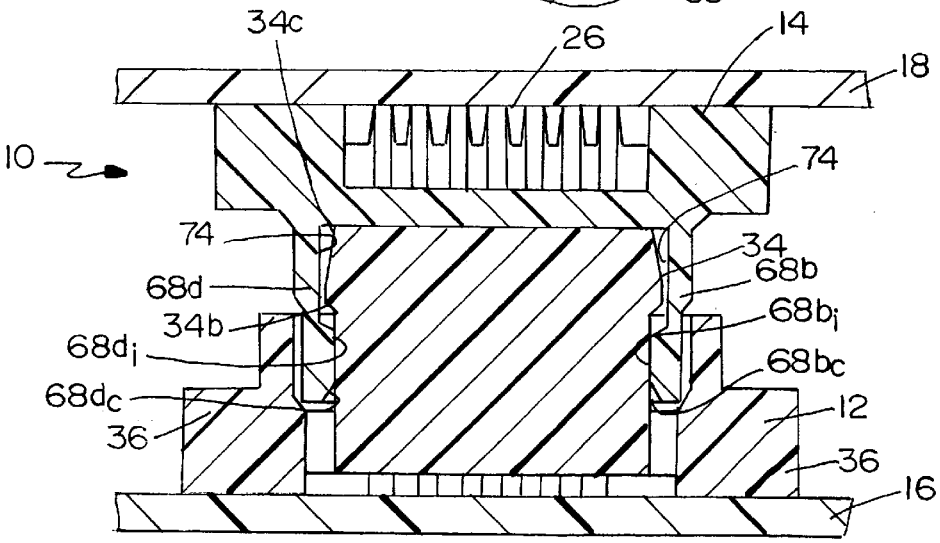
FIG. 11 is a cross-sectional view of the electric connector assembly of FIG. 10 taken along a line of view rotated 90° from that in FIG. 10.

Inner surfaces $68b_i$, $68d_i$ of end walls 68*b*, 68*d* of the receptacle connector 14 include indentations 74 for receiving projections 34 on outside surfaces of end walls 28*b*, 28*d* of the plug connector 12. The engagement of the projections 34 with the indentations 74 further secures the connectors 12, 14 together. The sectional view in FIG. 11 shows the interengagement of the projections 34 with the indentations 74.

The receptacle terminals 64 are fixed to the side walls 68*a* and 68*c* of the receptacle housing 62 in a convenient manner such as by insert molding them in the housing 62. The receptacle terminals 64 have contact sections 76 exposed inwardly into the mating recess 71 and tails 78 extend below the housing 60 for soldering to the circuit board 18.

The terminals 64 are preferably arranged at the same spacing as are the terminals 22 of the plug connector 12, with each terminal 64 being insert molded into the respective side wall 68*a* or 68*c* of the receptacle housing 62. In this orientation, outer surfaces of the contact section 76 are embedded in the side walls 68*a*, 68*c*, and exposed, inner surfaces of the contact section 76 of terminals 64 are substantially flush with the inner surfaces $68a_i$, $68c_i$ of side walls 68*a*, 68*c*, respectively, at the mating recess 71.

Figure 12:
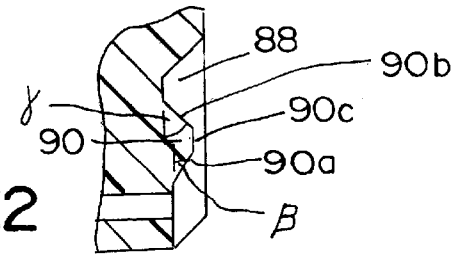
FIG. 12 is a close up view of a portion of the receptacle connector of FIG. 9.

As best seen in FIGS. 1 and 9, each side wall 68*a* and 68*c* of the receptacle housing 62 has a recess 88 formed on outer surfaces $68a_o$ and $68c_o$ which are intended to engage or "catch" the locking heads 60 of the locking portions 52 of the plug connector 12 when the plug and receptacle connectors 12, 14 are mated together. As seen in FIGS. 9 and 12, the recess 88 has an abutment 90, or shoulder, formed at a top thereof. The shoulder 90 has an insertion surface 90*a* and a retention surface 90*b* and a flat 90*c* therebetween. The locking heads 60 catch the retention surface 90*b* to cooperatively retain the plug and receptacle connectors 12, 14 together in an interlocked condition. The insertion surface 90*a* forms an angle $\beta$ with the respective side wall 68*a*, 68*c*, and the retention surface 90*b* forms an angle $\gamma$ with the respective side wall 68*a*, 68*c*. The angle $\gamma$ is greater than the angle $\beta$ to make the insertion force less than the retention force at the recess 88.

The features of the plug and receptacle connectors 12, 14 are beneficial for blind mating. During mating, the walls 68*a*–68*d* of the receptacle connector 14 are maneuvered to straddle the pedestal 24 and register with appropriate segments of the mating channel 42. The chamfered inner surfaces $68a_c$, $68c_c$, the slanted outer surfaces $68a_s$, $68c_s$, the radiused upper edges of pedestal walls 32*a*, 32*c* and the radiused inner surfaces of side walls 28*a*, 28*c* facilitate mating of the plug connector 12 and the receptacle connector 14. The pedestal 24 which is taller than the walls

28*a*–28*d* of the plug connector provide a locating portion which are straddled by walls 68*a*–68*d* with equal heights to facilitate registration of the plug and receptacle connectors 12, 14. Moreover, the laterally, centrally located projection 34 on pedestal end walls 32*b*, 32*d* directs insertion forces applied anywhere against the bottom 30 of the connector 12 to the projection 34. A projection disposed off center would not necessarily direct forces applied against the bottom of the connector which are not aligned with the projection to the projection. The alignment of the connectors 12, 14 are shown in FIG. 9.

Upon registration, the plug connector 12 and the receptacle connector 14 are permitted to move closer to each other as the walls 68*a*–68*d* of receptacle connector 14 engage respective segments 42*a*–42*d* of the mating channel 42. To complete mating, the plug connector 12 is pressed together with the receptacle connector 14.

It can be seen from FIG. 3 that the top edge of the insertion surface 34*a* of the projection 34 is disposed higher from the bottom 30 than the contact heads 58 of the terminals 22. FIG. 5 shows that the contact heads 58 are disposed higher from the bottom 30 than the locking head 60 of each terminal 22 of the plug connector 12. This staggers the order of engagement by contact heads 58 and projections 34 with corresponding portions of the receptacle connector 14.

During mating, the pedestal 24 of the plug connector 12 descends into the mating recess 71 of the receptacle connector 14. First, referring to FIG. 9, the insertion surface 34*a* of the projection 34 engages and travels along the chamfered surfaces 68$b_i$, 68$d_c$ and then the inner surfaces 68bi, 68di of the respective end walls 68*b*, 68d. When the pedestal 24 descends far enough into the mating recess 71, the retention surface 34*b* clears the top edge of the indentation 74, and the projection 34 is caught in the indentation 74.

Second, referring to FIGS. 10 and 11, the contact portion 50 of each terminal 22 of the plug connector 12, particularly the contact head 58 thereof, first engages and rides about the inner surface of the corresponding receptacle terminal 64 to termination with contact section 76. The contact portion 50 of the plug terminals 22 are preloaded slightly by their shape which extends the contact heads 58 toward the exterior of the plug connector 12. This preloading causes the contact portions 50, and particularly the contact heads 58 of terminal 22, to frictionally engage the contact section 76 of the terminal 64 to provide electrical connection and mechanical retention force.

Third, each locking portion 52 of the terminals 22 of the plug connector 12, particularly the locking head 60 thereof, engages the corresponding, top surface 68$a_t$, 68$c_t$ of the respective side wall 68*a*, 68*c* and descends along the respective outer surface 68$a_o$, 68$c_o$. The locking head 60 next engages the insertion surface 90*a* and then the flat 90*c* between the insertion surface 90*a* and the retention surface 90*b* of the shoulder 90. When the pedestal 24 descends deep enough into the mating recess 71, the locking heads 60 clear the flat 90*c* and are caught in the recess 88 and constrained by the retention surface 90*b*. The interengagement of the projections 34 of the plug connector 12 with the indentations 74 of the receptacle connector 14, the contact portions 50 of terminals 22 with contact sections 76 of the terminals 64 and the locking portions 52 of terminals 22 and the catches 88 reliably retain the connectors 12, 14 together.

The three-stage insertion action dilutes the insertion force. Because the insertion surface 34*a* of the projection initially engages the receptacle connector 14 before the contact head 58 initially engages the receptacle connector 14 which is before the locking head 60 initially engages the receptacle connector 14, the initial frictional engagement forces do not cumulatively operate to resist insertion, thereby diluting the insertion force. To further dilute the insertion force, the chamfered surfaces 68$b_c$, 68$d_c$ facilitate the travel of the projections 34 along the end walls 68*b*, 68*d*, and the radiused outer surface at the top bend of the terminals 64 facilitates the travel of the contact head 58 along the terminals 64. Additionally, the angle $\Theta$ of the insertion surface 34*a* of the projection 34 with the respective side wall 32*a*, 32*c* of the pedestal 24 is less than the angle $\phi$ defined by the retention surface 34*b* and the respective wall 32*a*, 32*c* of the pedestal 24. Consequently, the insertion force generated by the projection 34 will be less than the retention force. Furthermore, the angle $\beta$ defined by insertion surface 90*a* of the abutments 90 with the inner surface 68$a_i$, 68$c_i$ is less than the angle $\gamma$ defined by the retention surface 90*b* and the inner surface 68$a_i$, 68$c_i$ of the side wall 68*a*, 68*c*, respectively. Accordingly, the insertion force generated by the abutments 90 will be less than the retention force generated thereby.

FIGS. 10 and 11 illustrate the plug and receptacle connectors 12 and 14 mated together. The solder tail portions 56 of the terminals 22 of the plug connector 12 are soldered to the printed circuit board 16, whereas the solder tails 78 of the terminals 64 of the receptacle connector 14 are soldered to the printed circuit board 18. Mating the plug connector 12 with the receptacle connector 14 establishes an electrical connection between the printed circuit boards 16 and 18.

The electric connector assembly 10 according to the present invention assures reliable coupling of the connectors 12, 14 without requiring any extra operation. The metal terminals 22 of the plug connector 12 exert a frictional retention force on the opposing receptacle connector 14. The combination of interlocking projections 34 of the plug connector 12 and the indentations 74 of the receptacle connector, the direct engagement by the locking portions 60 of terminals 22 of the plug connector 12 with abutments 90, coupled with the frictional engagement by the contact portions 50 of the plug connector 12 with the contact sections 76 of the terminals 64 of the receptacle connector 14 increases the withdrawal force necessary to separate the connectors 12, 14 apart. Thus, with this "three-stage" retention provision, the likelihood of accidental unmating of the connectors 12, 14 of the connector assembly 10 and their corresponding circuit boards 16, 18 is significantly decreased.

While the preferred embodiments of the invention have been shown and described, it will be apparent to those skilled in the art that changes and modifications may be made therein without departing from the spirit of the invention, the scope of which is defined by the appended claims.

I claim:

1. An electrical connector for mating with a corresponding opposing electrical connector in order to effect a connection between two curcuit boards, said connector comprising: a housing formed from an electrically insulative material, including a bottom, a pedestal projecting from said bottom of said housing, said pedestal including a pair of opposed pedestal side walls and a pair of opposed pedestal end walls, a plurality of electrically conductive terminals disposed in spaced-apart order in said housing along a longitudinal axis of said housing, the terminals each including a retention portion for retaining said terminal in place in said spaced-apart order in said housing and a contact portion disposed along said pedestal side walls for contacting an opposing terminal of the opposing connector, and a rigid projection centrally disposed directly on the pedestal end wall for engaging a correspondingly configured indentation in a complementary wall of the opposing connector during mating to maintain said connector in mating engagement with the opposing connector.

2. The connector as defined in claim 1 wherein said terminals further include a locking portion for engaging a portion of a housing of the opposing connector upon mating said connector with the opposing connector.

3. The connector as defined in claim 2, wherein said locking portion of said terminals is spaced apart from said contact portion to define an intervening nest therebetween that receives part of the opposing connector when the opposing connector is mated to said connector.

4. The connector as defined in claim 1, wherein said projection is disposed at a higher elevation above said floor than a top of said contact portion.

5. The connector as defined in claim 2, wherein a top of said contact portion is disposed at a higher elevation above said floor than a top of said locking portion.

6. The connector as defined in claim 1, wherein a top of said contact portion and said projection are disposed at different elevations above said bottom of said housing.

7. The connector as defined in claim 1, wherein said retention portion has opposing, symmetrical edges defining a face, each opposing edge includes an insertion segment said insertion segment adjoining a first vertical segment, said first vertical segment being angularly related to said insertion segment, said first vertical segment adjoining a radially recessed segment, said recessed segment adjoining a second vertical segment, an area of said face adjacent said insertion segment of each edge tapering in a plane which is angularly related to the plane defined by said face.

8. The connector as defined in claim 1, wherein said retention portion is disposed on said terminal on said locking portion.

9. The connector as defined in claim 7, wherein said vertical edges of said retention portion skive into inner walls of a lock cavity in said housing.

10. The connector as defined in claim 1 wherein said housing includes a pair of opposed side walls projecting from said bottom, each of said side walls facing a respective one of said pedestal side walls.

11. The connector as defined in claim 10 wherein said pedestal is disposed higher above said bottom of said housing than said side walls.

12. The connector as defined in claim 1 in combination with the opposing electrical connector comprising an electrical connector assembly.

13. An electrical connector for mating with a corresponding opposing electrical connector in order to effect a connection between two circuit boards, said connector comprising: a housing formed from an electrically insulative material, including a bottom, a pair of opposed side walls projecting from said bottom, a pedestal projecting from said bottom of said housing comprising a pair of opposed pedestal side walls each facing a respective one of said pair of opposed side walls of said housing and a pair of opposed pedestal end walls, a plurality of electrically conductive terminals disposed in spaced-apart order in said housing along a longitudinal axis of said housing, the terminals each including a retention portion for retaining said terminal in place in said spaced-apart order in said housing, a contact portion disposed along said pedestal walls for contacting a respective terminal of the opposing connector upon mating said connector with the opposing connector and a locking portion for engaging a portion of a housing of the opposing connector during mating of said connector with the opposing connector, said locking portion being spaced apart from said contact portion, and a projection disposed on at least one of said end pedestal walls for engaging a correspondingly configured indentation in a complementary wall of the opposing connector during mating to maintain said connector in mating engagement with the opposing connector, tops of said projection, said locking portions and said contact portions being disposed at different elevations with respect to said bottom to avoid simultaneous initial contact by said tops of said projection, said locking portions and said contact portions with respective portions of the opposing connector.

14. The connector defined in claim 11, wherein said terminals further include a locking portion for engaging a portion of a housing of the opposing connector during mating of said connector with the opposing connector, said locking portion being spaced apart from said contact portion and a top of said locking portion being disposed at an elevation with respect to said bottom which avoids simultaneous initial contact by said top of said locking portion with the opposing connector and by one of said projection and said contact portions with respective portions of the opposing connector.

15. A terminal for an electrical connector having a contact portion, a tail portion and a retention portion, said retention portion comprising:

two substantially similar edges, each of said edges including an insertion segment, a first vertical segment adjoining said insertion segment, said insertion segment being angularly related to said first vertical segment, a radially recessed segment adjoining said first vertical segment, and a second vertical segment adjoining said radially recessed segment; and said retention portion defining a face and areas of said face adjacent to said insertion segment of each edge being tapered angularly with respect to a plane defined by said face.

16. An electrical connector for mating with a corresponding opposing electrical connector in order to effect a connection between two circuit boards, said connector comprising: a housing formed from an electrically insulative material, including a bottom, a pedestal projecting from said bottom of said housing, said pedestal including a pair of opposed pedestal side walls and a pair of opposed pedestal end walls, a plurality of electrically conductive terminals disposed in spaced-apart order in said housing along a longitudinal axis of said housing, the terminals each including a retention portion for retaining said terminal in place in said spaced-apart order in said housing, a locking portion for engaging a portion of a housing of the opposing connector upon mating said connector with the opposing connector and a contact portion disposed along said pedestal side walls for contacting an opposing terminal of the opposing connector, said locking portion of said terminals being spaced apart from said contact portion to define an intervening nest therebetween that receives part of the opposing connector when the opposing connector is mated to said connector and a projection centrally disposed on the pedestal end wall for engaging a correspondingly configured indentation in a complementary wall of the opposing connector during mating to maintain said connector in mating engagement with the opposing connector.

17. An electrical connector for mating with a corresponding opposing electrical connector in order to effect a connection between two circuit boards, said connector comprising: a housing formed from an electrically insulative material, including a bottom, a pedestal projecting from said bottom of said housing, said pedestal including a pair of opposed pedestal side walls and a pair of opposed pedestal end walls, a plurality of electrically conductive terminals disposed in spaced-apart order in said housing along a longitudinal axis of said housing, the terminals each including a retention portion for retaining said terminal in place in said spaced-apart order in said housing, a locking portion for engaging a portion of a housing of the opposing connector upon mating said connector with the opposing connector and a contact portion disposed along said pedestal side walls for contacting an opposing terminal of the opposing connector, a top of said contact portion being disposed at a higher elevation above said floor than a top of said locking portion, and a projection centrally disposed on the pedestal end wall for engaging a correspondingly configured indentation in a complementary wall of the opposing connector during mating to maintain said connector in mating engagement with the opposing connector.

* * * * *